US006109686A

United States Patent [19]

Fox

[11] Patent Number: 6,109,686

[45] Date of Patent: Aug. 29, 2000

[54] CHAIR FOR USE BY AN ADULT OR A CHILD

[76] Inventor: Allan B. Fox, 2800 Shafor Blvd., Apt. 3, Dayton, Ohio 45419

[21] Appl. No.: 09/238,839

[22] Filed: Jan. 27, 1999

Related U.S. Application Data

[63] Continuation-in-part of application No. 09/058,665, Apr. 9, 1998, abandoned.

[60] Provisional application No. 60/043,787, Apr. 11, 1997.

[51] Int. Cl.[7] ..... A47C 13/00

[52] U.S. Cl. ..... 297/105; 297/236; 297/440.15; 297/232; 297/423.38; 297/423.4

[58] Field of Search ..... 297/105, 108, 297/219.12, 230.14, 230.1, 236, 237, 283.2, 378.1, 423.19, 423.38, 423.4, 440.15, 15, 106, 232, 233, 234, 238, 241, 344.21

[56] References Cited

U.S. PATENT DOCUMENTS

| | | | |
|---|---|---|---|
| 834,427 | 10/1906 | Wheatley | 297/236 X |
| 910,357 | 1/1909 | Case | 297/237 |
| 1,016,886 | 2/1912 | Hegerhorst | 297/236 |
| 1,149,545 | 8/1915 | Sherr | 297/237 |
| 1,471,006 | 10/1923 | Schmidt | 297/237 |
| 4,555,135 | 11/1985 | Freeland | 297/105 |
| 4,768,827 | 9/1988 | Musgrove | 297/15 X |

FOREIGN PATENT DOCUMENTS

| | | | |
|---|---|---|---|
| 403267001 | 11/1991 | Japan | 297/237 |

*Primary Examiner*—Laurie K. Cranmer
*Attorney, Agent, or Firm*—Mark F. Smith; Smith, Guttag & Bolin Ltd.

[57] ABSTRACT

The present device is directed to an improved chair, such as an office or a computer chair, for use by adults and which is easily convertible for use by children. The chair comprises a seat and an adult back rest secured to a chair frame. The seat includes a back portion, side portions, a generally flat recessed central portion forming a cavity, and an adult seating cushion nested within the cavity. The adult seating cushion is pivotally mounted for rotatably folding into and out of its nesting position within the cavity. Further nested within the cavity and positioned between the adult seating cushion and the recessed central portion of the seat is a child seat having a base plate and a child back support. The child seat is pivotally mounted for rotatably folding the child back support into and out of its nesting position within the cavity. In a preferred embodiment of the invention, the chair includes a foot support mounted to the seat for use by a child.

18 Claims, 5 Drawing Sheets

CHAIR FOR USE BY AN ADULT OR A CHILD

RELATED APPLICATIONS

This is a continuation-in-part of U.S. patent application Ser. No.: 09/058,665, Filed: Apr. 9, 1998 now abandoned which is based on U.S. provisional application Serial No.: 60/043,787, Filed: Apr. 11, 1997.

BACKGROUND OF THE INVENTION

This invention relates to a chair and, more particularly, to a chair that is properly sized for use by an adult and which is easily converted to a chair that is properly sized and provides support and protection for use by children.

It is well known that chairs have been constructed having frames that support padding covered with various types of fabric or leather upholstery to create cushions. One such chair is commonly known as an office chair, or more recently, a computer chair. Typically, this type of chair includes a back rest and a seat attached to a swivel mechanism and supported by a base. It is well known in the industry that a chair providing the proper support will significantly improve the posture of the user and reduce or relieve back strain on the user as well as poor circulation, and fatigue. Unfortunately, however, such chairs are sized to provide proper support when used by adults and are therefore generally too large and do not provide the proper support or protection when used by children.

Until now, children learning to use a computer were often seated in such conventional computer chairs. To be able to reach the keyboard of the computer, the children typically sit with their legs tucked under them or sit on pillows or other means for placing them in position to use the computer. Such methods, however, are uncomfortable and are generally unacceptable for sitting for long periods of time. Further, depending on the size of the pillow or the positioning means used, the pillow or the positioning means may slide along the seat of the chair; sitting on the chair is cumbersome, and may result in injury to the child. In addition, computer chairs designed for adults generally do not provide foot supports for use by children or are not easily adjustable in relation to the seat. This lack of foot support decreases the stability of the chair and increases the chance that the chair may tilt and are therefore unacceptable for use by young children. With the introduction of computer programs designed for young children, a parent wishing to permit a young child to use a computer is often required to sit in the computer chair and hold the child in proper position and provide support for the child. Unfortunately, such an arrangement does not permit the child to work alone and is usually uncomfortable for both the child and the parent and therefore is not conducive to computer use for long periods of time. While chairs have been developed that are specifically designed for use by children, such chairs are often undesirable because of the additional space and cost associated with having a separate chair for use by an adult and a separate chair for use by a child.

Booster seats have been developed and may be placed on conventional office or computer chairs. Unfortunately, however, such booster seats do not adjust for keyboard height and are often unstable and cumbersome. Further, such booster seats require adults to lift the booster seats and place them on or off the chairs when the chairs are to be used by children or adults, respectively. This can be especially difficult, or at least annoying, depending on the weight of the booster seat, the size and physical condition of the adult, and the number of times the booster seat is placed on or off the chair. Further, such booster seats require storage when not in use and generally do not provide support for a child's feet.

Accordingly, the ever-increasing use of computers by children has resulted in a need for a chair that an adult or a child can use, that will properly position an adult or a child to use a computer, that will allow an adult or a child to sit comfortably for relatively long periods of time in the chair, that will properly position and aid an adult or a child in sitting and maintaining the proper posture during the sitting period, and will relieve or reduce the likelihood of an adult or child suffering back strain, poor circulation, and fatigue. Further, a need exists for a chair that is relatively simple in design and inexpensive to manufacture, relatively simple to use and easily converted from an adult seating configuration to a child seating configuration and vice versa, and that provides leg support for use by a child.

SUMMARY OF THE INVENTION

The present invention is directed to an improved chair, such as an office or a computer chair, for use by adults and which is easily convertible for use by children. The chair comprises a seat and an adult back rest secured to a chair frame. The seat includes a back portion, side portions, a generally flat recessed central portion forming a cavity, and an adult seating cushion nested within the cavity. The adult seating cushion is pivotally mounted for rotatably folding into and out of its nesting position within the cavity. Further nested within the cavity and positioned between the adult seating cushion and the recessed central portion of the seat is a child seat having a base plate and a child back support. The child seat is pivotally mounted for rotatably folding the child back support into and out of its nesting position within the cavity.

In a preferred embodiment of the invention, the chair includes a base having means for permitting easy movement of the chair along the floor.

In another preferred embodiment of the invention, the chair includes means for swiveling the chair seat.

In another preferred embodiment of the invention, the chair includes means for adjusting the adult back rest.

In another preferred embodiment of the invention, the chair comprises a safety means for securing and maintaining the child in the proper position.

In another preferred embodiment of the invention, the chair comprises an arm rest for use by an adult user.

In another preferred embodiment of the invention, the chair comprises an arm rest for use by a child user.

In another preferred embodiment of the invention, the chair comprises means for supporting the feet of a child.

In another preferred embodiment of the invention, the means for supporting the feet of a child is adjustable.

In another preferred embodiment of the invention, the means for supporting the feet of the child is removably attached to the chair.

In another preferred embodiment of the invention, the means for supporting the feet of a child includes a decorative covering.

In another preferred embodiment of the invention the seat is removably attached to the chair frame.

Therefore, a primary object of this invention is to provide a chair that is properly sized for use by an adult.

Another primary object of this invention is to provide a chair that is properly sized for use by a child.

Another primary object of this invention is to provide a chair that properly positions an adult to use a computer.

Another primary object of this invention is to provide a chair that properly positions a child to use a computer.

Another primary object of this invention is to provide a chair that is properly sized for use by an adult and which is easily converted to the proper size for use by a child.

Another primary object of this invention is to provide a chair that is comfortable when used by an adult.

Another primary object of this invention is to provide a chair that is comfortable when used by a child.

Another primary object of this invention is to provide a chair which may be used by young children.

Another primary object of this invention is to provide a chair that properly positions and aids an adult in sitting and maintaining the proper posture during the sitting period.

Another primary object of this invention is to provide a chair that properly positions and aids a child in sitting and maintaining the proper position during the sitting period.

Another primary object of this invention is to provide a chair that will relieve or reduce back strain, poor circulation, and fatigue when used by an adult.

Another primary object of this invention is to provide a chair that will relieve or reduce back strain, poor circulation, and fatigue when used by a child.

Another primary object of this invention is to provide a chair having a foot support that may be used by children.

Another primary object of this invention is to provide a chair having a seat which is easily removable.

Another primary object of this invention is to provide a chair having a seat which is adaptable for use on various frame supports.

Another primary object of this invention is to provide a chair sized for use by adults and which is easily converted to the proper size for use by a child without tools.

Another primary object of this invention is to provide a chair that is relatively inexpensive to manufacture.

Another primary object of the invention is to provide a chair that is space saving.

These and other objects and advantages of the invention will be apparent from the following description, the accompanying drawings and the appended claims.

DETAILED DESCRIPTION OF THE PREFERRED EMBODIMENT

Figure 1:
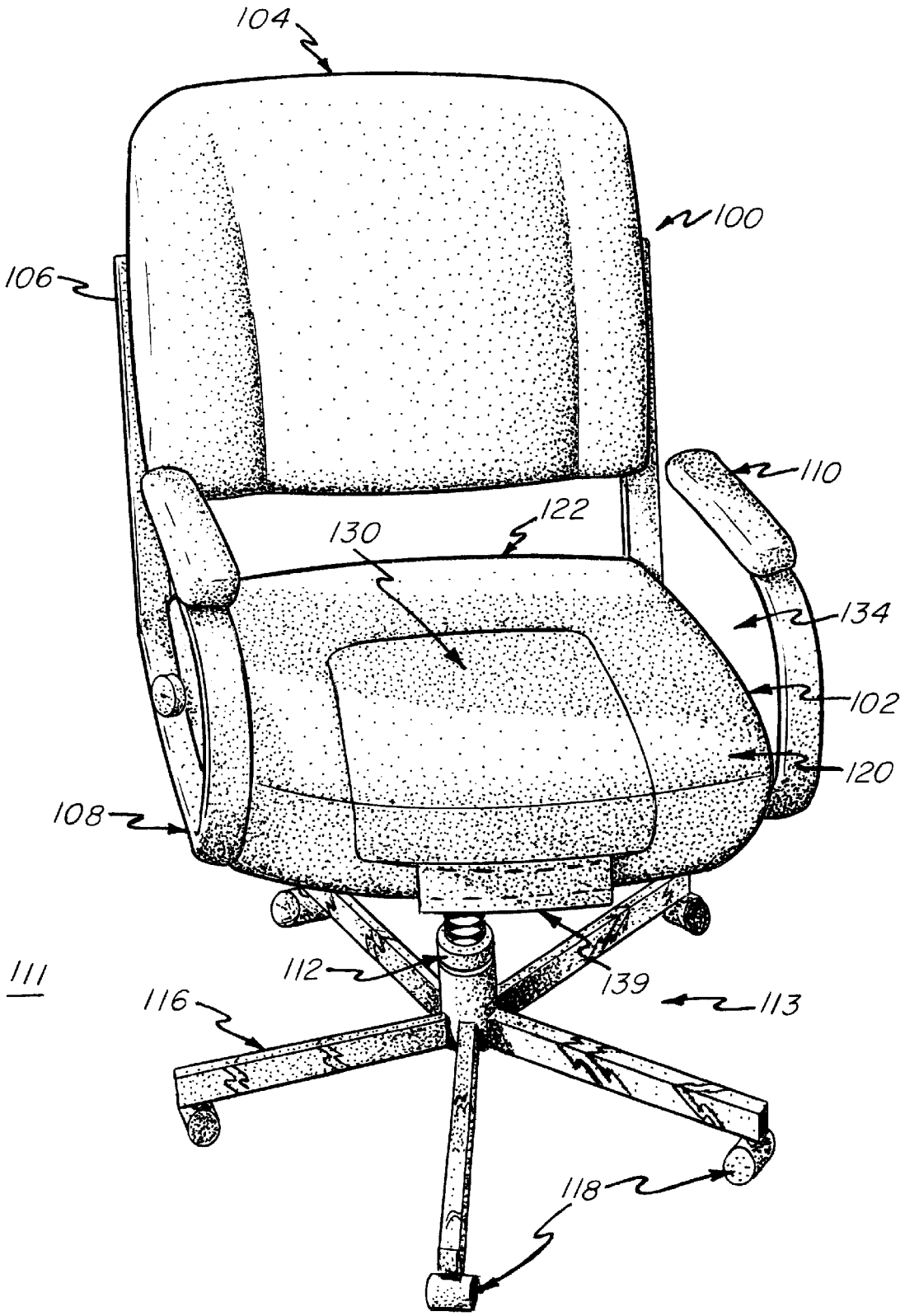
FIG. 1 is a perspective view of the chair of the present invention showing the adult seating cushion in its nested configuration for use of the chair by an adult.
Figure 2:
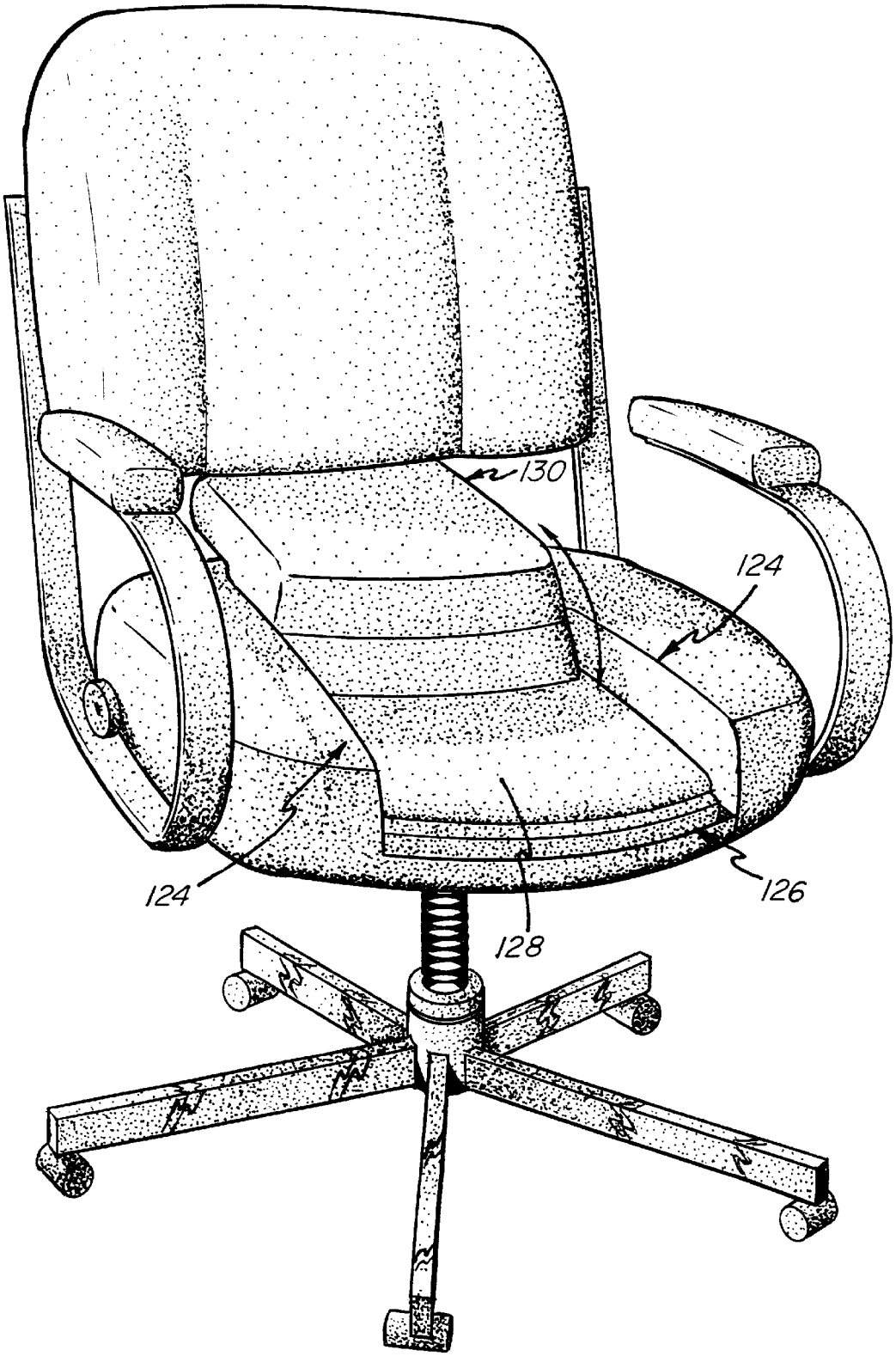
FIG. 2 is a perspective view of the chair of the present invention showing the adult seating cushion in its folded non-nested configuration for use of the chair by a child.

Referring to the drawings, and initially FIGS. 1 and 2, the chair of the present invention is shown, generally designated 100. As shown, the chair 100 comprises a seat 102 and an adult back rest 104 secured to a conventional chair frame 106 having a seat support 108 and substantially horizontally extending adult arm rests 110. The seat 102 is adapted to be placed on the seat support 108 and secured thereto by conventional means, such as by screws, clips, or a hook and loop system. The seat support 108 includes a swivel mechanism 112 supported by a base 114. The swivel mechanism 112 is conventional in design and allows the seat support 108 to pivot for rotating the seat 102 to permit the user to turn the chair 100 toward or away from the work station without having to push the chair 100 toward or away from the work station before getting into or out of the chair 100. Further, in a preferred embodiment of the invention, the swivel mechanism 110 may be part of a synchronous control, as well-known in the art, for permitting back tilt and seat tilt.

As used herein, the terms "horizontal" or "horizontally" corresponds to the plane substantially parallel to the floor 111 and the term "vertical" refers to the plane substantially perpendicular to the floor 111 and the terms "downward" or "downwardly" corresponds to a direction toward the floor 111 and the terms "upward" or "upwardly" correspond to a direction away from the floor 111.

The base 114 is also conventional in design and may include a single base or a plurality of legs 116, such as the star configuration as shown, formed from metal or wood. Caster type wheels or rollers 118 may be attached to the legs 116 to permit easy movement of the chair 100 along the floor 111. The number of wheels 118 will correspond with the number of legs 116 supporting the seat 102. The legs 116 are preferably formed of metal and the wheels 118 are preferably formed of metal or rigid plastic.

The seat 102 is constructed using a conventional underlying frame support (not shown) and includes a seat cushion 120 formed from a foam plastic and covered with a fabric or leather and includes a back portion 122, side portions 124, a generally flat recessed central portion 126 forming a cavity 128, and an adult seating cushion 130 nested within the cavity 128. It should now be apparent that while the seat cushion 120 is preferably formed from a covered foam plastic, other materials, covered or not covered, such as other plastics, wood, and the like may be used without departing with the scope of the present invention.

The adult seating cushion 130 is pivotally mounted to the back portion 122 of the seat 102 for rotatably folding into (FIG. 1) and out (FIG. 2) of its nesting position. When the chair 100 is in its adult seating configuration, as illustrated in FIG. 1, the adult seating cushion 128 is in its nested position with its back side 129 generally flush with the upper surfaces of the back portion 122 and side portions 124 of the seat cushion 120 to provide a substantially flat horizontal adult seating surface 134.

Figure 3:
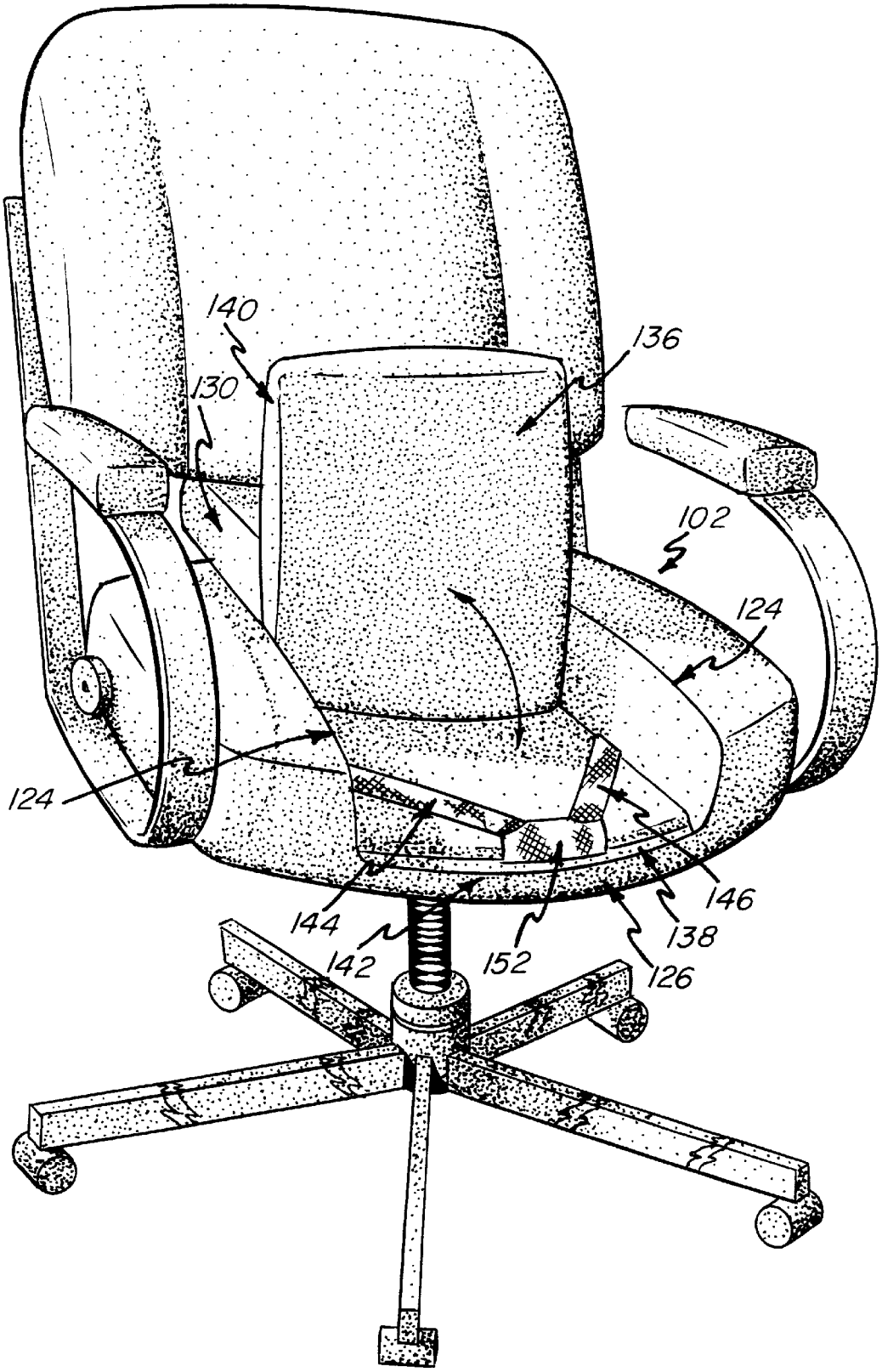
FIG. 3 is a perspective view of the chair of the present invention showing the adult seating cushion and the child back support in their fully non nested position for use of the chair by a child.

As shown in FIG. 3, nested within the cavity 128 and positioned between the adult seating cushion 130 and the recessed central portion 126 of the seat 102 is a child seat 136 having a base plate 138 and a child back support 140. The child seat 136 is secured to the recessed central portion 126 of the seat 102 by conventional means, such as by screws, clips, or a hook and loop system, and mounted to the child back support 140 to permit rotational movement of the child back support 140 into and out of its nesting position within the cavity 128. Accordingly, the chair 100, when in its child seating configuration, the adult seating cushion 130 is rotatably folded from its stored generally horizontal nested position (FIG. 1) to its generally vertical non-nested position (FIG. 2) to expose the child back support 140. The child back support 140 may then be rotatably folded from its stored generally horizontal nested position up into a generally vertical non-nested position (FIG. 3) and will rest against the adult seating cushion 130 to act as a back support or rest when in an unfolded position. In operation, the adult seating cushion 130 will provide the child back support 140 with flexibility and will act as shock absorbing device as well as providing means for adjusting the child seat 136 to various child sizes. As shown in FIG. 3, when the chair 102 is in the child seating configuration, the generally horizontal surfaces of the side portions 124 of the cushion 120 will operate as arm rests and will cooperate with the general vertical surfaces of the side portions 124 and the back portion 122 to provide lateral support for the child user. It should also now be apparent to one skilled in the art that the base plate 138 of the child seat 136 may be provided with cushioning for providing added comfort for the user. In addition, such cushioning may vary in thickness to properly position the child to use a computer or a desk surface without requiring the user to adjust the vertical position of the seat support.

In order to enhance the appearance of the seat, as shown in FIG. 1, the adult seating cushion 130 may be provided with a front flap 139 having one end securely attached to the underside of the adult seating cushion 130 and the other end is removably secured to the underside of the seat 102 by a conventional hook and loop fastening means (not shown). It should now be apparent to one skilled in the art that the front flap 139 conceals the child seat 136 when nested, and may be formed from the same or similar covering as used for the seat cushion 120.

In order to further improve the utility of the invention a conventional belt type safety means 142 is coupled with respect to the child seat 136. In a preferred embodiment of the invention, as shown in FIGS. 3, the safety means is formed of at least two belt components 144, 146, having interior ends secured to the seat 102. The exterior ends of the belt components 144, 146 are provided with buckling components 152 for releasably securing the belt components 144, 146 around the waist of the child user. Thus, the child using the chair 100 in the child seating configuration may be held along the sides by side portions 124 and the back by the child back support 140, and prevented from falling forward by the safety means 142. It should now be apparent to one skilled in the art that the safety means 142 may be adjusted to accommodate the size of the child user by conventionally increasing or decreasing the length of the two belt components 144, 146.

Figure 4:
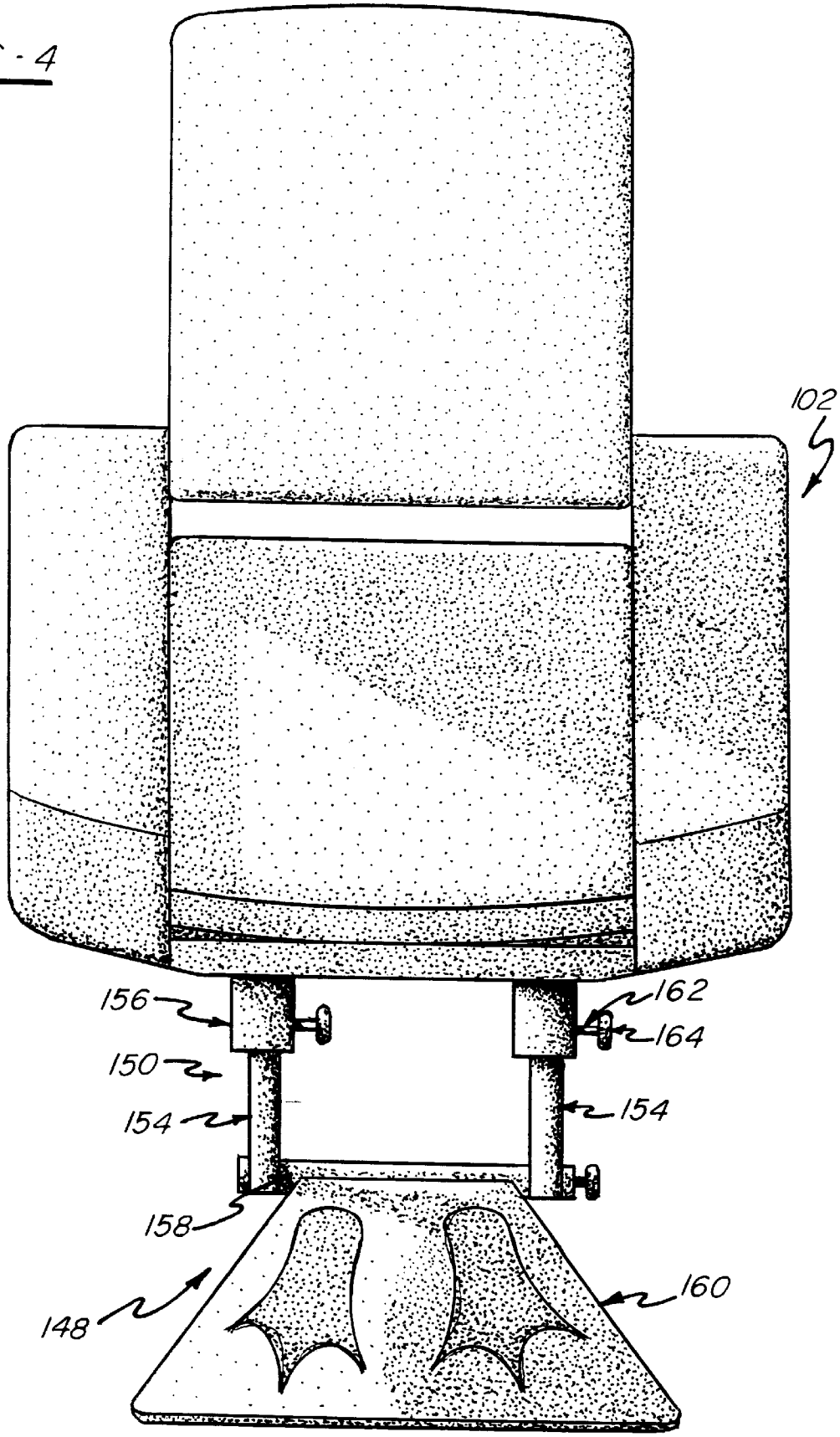
FIG. 4 is a schematic front view of the seat of the chair of the present invention showing a belt type safety means and showing an adjustable foot support.

Referring to FIG. 4, illustrates another preferred embodiment whereby the seat 102 includes a foot support, generally indicated at 148, comprising a pair of telescopic tubes 150 each having inner and outer tubes 154, 156, respectively, that telescopically extend outwardly and substantially vertically downwardly from the front edge of the seat 102. Preferably the telescopic tubes 150 are formed of plastic or metal. A shaft 158 extends transversely of the seat 102 and is rotatably mounted to the lower ends of each inner tube 154 and includes a foot plate 160 for supporting the feet of the child user. The top end of each inner tube 154 is fixedly secured to the underlying frame support of the seat 102 by clamps, pins, screws, welding, and other like means. The inner and outer tubes 154, 156 of each telescopic tube 150 are coupled with each other by a locking screw 162, which are provided with a knob 164 for manually rotating the screw 162, extending through a threaded aperture in the outer tube 156 to engage against the respective inner tube 154 for frictionally securing the foot rest 148 in a generally vertically desired elevation. The use of telescopic tubes permits the foot support to be easily decorated, such as having the appearance of duck legs and feet. It should now be apparent to one skilled in the art that various foot supports may be used, including foot supports having one vertical tube, or flexible plastic tubing, or having various conventional adjusting means for supporting the foot plate may be used without departing from the present invention.

Figure 5:
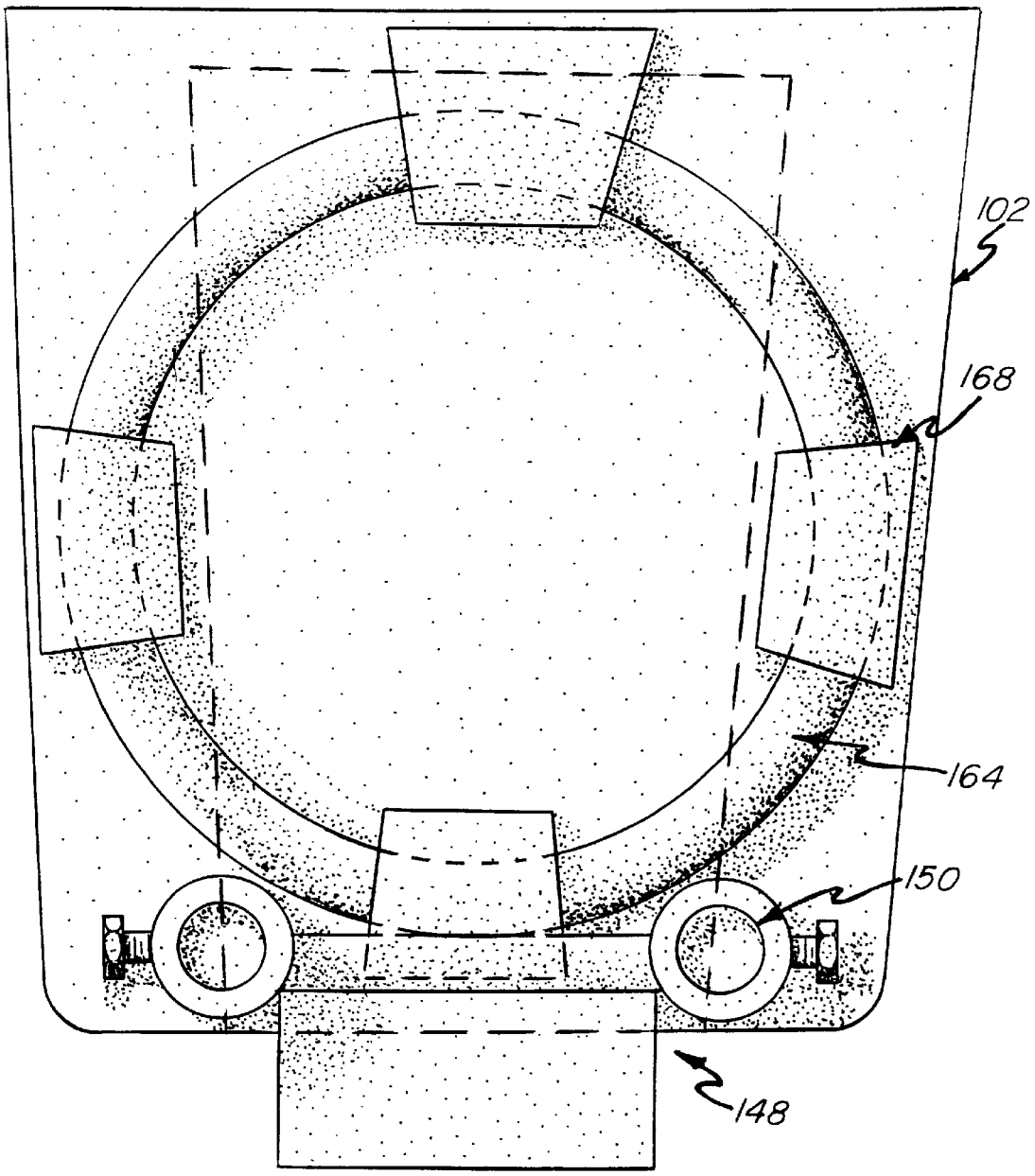
FIG. 5 is a schematic bottom view of the cushion of the present invention showing a foot support attachment apparatus for removably attaching the foot support.

In another preferred embodiment of the invention, as shown in FIG. 5, the top ends of each telescopic tube 150 are mounted to an upper support 164 which can be inserted through sleeves 168 attached to the underside of the seat 102 to permit the foot support 148 to be easily attached or detached from the seat 102. It should now be apparent that various other methods may be used to mount the particular foot support selected to the underside of the seat without departing from the present invention.

It should now be apparent that the chair of the present invention can be used by either an adult or a child for relatively long periods of time. In addition, the chair of the present invention properly positions and aids an adult or a child in sitting and maintaining the proper posture during the sitting period and will relieve or reduce the chances of the user suffering from back strain, poor circulation, and fatigue. It should also now be apparent that the chair of the present invention is relatively simple in design and inexpensive to manufacture, is simple to use and easily converted from an adult seating configuration to a child seating configuration and vice versa. Further, it should also now be apparent that the chair of the present invention requires no additional storage space, and may be used by young children without the aid of an adult.

While the forms of apparatus described herein constitute preferred embodiments of the present invention, it is to be understood that the invention is not limited to these precise forms of apparatus, and that changes, including variations in size, materials, shape, form, function or manner of operation, may be made therein without departing from the scope of the invention which is defined in the appended claims.

What is claimed is:

1. A chair for use by an adult and for use by a child comprising:

a seat for facing an adult in a first direction and having a cavity therein;

an adult seating cushion removably nested within said cavity; and a child seat having a child back support pivotally mounted towards the back portion of said seat for rotating the child back support into a nesting position within said cavity and out of a nesting position within said cavity to form a child seat within said cavity for facing a child in said first direction.

2. The chair of claim 1 further comprising a base for supporting the seat above a floor.

3. The chair of claim 2 further comprising means for permitting easy movement of the chair along the floor.

4. The chair of claim 1 further comprising means for swiveling the seat.

5. The chair of claim 1 wherein said adult seating cushion is pivotally mounted for rotating into and out of a nesting position within said cavity.

6. The chair of claim 1 further comprising safety means for securing and maintaining the child in the proper position.

7. The chair of claim 1 wherein said adult seating cushion operates as an arm rest for said child seat.

8. The chair of claim 1 further comprising means for concealing said child seat when said child seat is in its nesting position within said cavity.

9. The chair of claim 1 further comprising means for supporting the legs of a child.

10. A chair for use by an adult and for use by a child comprising:

a chair frame;

a seat removably secured to said chair frame and having a back portion, side portions, a generally flat recessed central portion forming a cavity, and an adult seating cushion nested within said cavity; and a child seat having a base plate and a child back support;

wherein said adult seating cushion is pivotally mounted for rotatably folding into and out of a nesting position within said cavity; and wherein said child back support is pivotally mounted for rotatably folding into and out of a nesting position within said cavity.

11. The chair of claim 10 wherein said child seat is positioned between said adult seating cushion and said recessed central portion.

12. The chair of claim 10 further comprising a base for supporting the seat above a floor.

13. The chair of claim 12 further comprising wheels mounted to said base for permitting easy movement of the chair along the floor.

14. The chair of claim 10 further comprising a swivel mechanism for rotating the seat.

15. The chair of claim 10 further comprising safety means for securing and maintaining the child in the proper position.

16. A chair for use by an adult or for use by a child comprising;

chair frame having a seat support;

a seat removably secured to said seat support and comprising a seat cushion having a back portion, side portions, a generally flat recessed central portion forming a cavity, and an adult seating cushion;

an adult back rest secured to said chair frame;

a child seat having a base plate and a child back support;

whereas said seat support comprises a swivel mechanism and a base;

whereas said adult seating cushion is pivotally mounted for rotationally folding into and out of a nesting position within said cavity;

whereas said child back support is pivotally mounted for rotationally folding into a nesting position within said cavity and out of a nesting position thereby forming a child seat within said cavity.

17. The chair of claim 16 further comprising a belt means having a buckling component for releasably securing the belt components around the waist of a child.

18. The chair of claim 16 further comprising a foot support for supporting the feet of a child.

* * * * *